US007074326B2

(12) United States Patent
Singleton

(10) Patent No.: US 7,074,326 B2
(45) Date of Patent: Jul. 11, 2006

(54) CURB-AND-GRATE INLET FILTER

(75) Inventor: Earl Roger Singleton, Oxford, GA (US)

(73) Assignee: Silt-Saver, Inc., Conyers, GA (US)

( * ) Notice: Subject to any disclaimer, the term of this patent is extended or adjusted under 35 U.S.C. 154(b) by 73 days.

(21) Appl. No.: 10/801,352

(22) Filed: Mar. 16, 2004

(65) Prior Publication Data

US 2004/0200767 A1 Oct. 14, 2004

Related U.S. Application Data

(60) Provisional application No. 60/462,760, filed on Apr. 14, 2003.

(51) Int. Cl.
*E03F 5/06* (2006.01)

(52) U.S. Cl. ..... 210/163; 210/315; 210/474; 210/489; 210/497.1; 404/4

(58) Field of Classification Search ..... 210/163, 210/164, 315, 317, 337, 474, 489, 499, 494.1, 210/497.1; 404/4, 5
See application file for complete search history.

(56) References Cited

U.S. PATENT DOCUMENTS

| | | | | |
|---|---|---|---|---|
| 248,559 A | | 10/1881 | Jackson | |
| 1,711,674 A | * | 5/1929 | Egan | 210/163 |
| 2,201,279 A | | 5/1940 | Willing | 61/35 |
| 2,375,345 A | | 5/1945 | Burhans | 210/204 |
| 2,889,932 A | | 6/1959 | Mackintosh | 210/450 |
| 3,695,443 A | | 10/1972 | Schmidt, Jr. | 210/315 |
| 3,739,913 A | | 6/1973 | Bogosian | |
| 3,830,373 A | | 8/1974 | Sixt et al. | 210/489 |
| 3,972,078 A | * | 8/1976 | Maki | 210/163 |
| 4,094,790 A | | 6/1978 | Schmidt, Jr. | 210/289 |
| 4,162,863 A | | 7/1979 | Gaudard et al. | 405/45 |
| 4,180,464 A | | 12/1979 | Beane | 210/497 |
| 4,418,432 A | * | 12/1983 | Vidal | 210/163 |
| 4,594,157 A | | 6/1986 | McGowan | 210/163 |
| 5,107,635 A | * | 4/1992 | Carpenter | 210/474 |
| 5,297,895 A | | 3/1994 | Johnson | 405/41 |
| 5,345,741 A | | 9/1994 | Slater et al. | 52/646 |
| 5,372,714 A | | 12/1994 | Logue, Jr. | 210/164 |
| 5,389,166 A | | 2/1995 | White | 156/71 |
| 5,403,474 A | | 4/1995 | Emery | 210/163 |
| 5,405,539 A | * | 4/1995 | Schneider | 210/163 |
| 5,407,570 A | * | 4/1995 | Hobson, Jr. | 210/499 |

(Continued)

OTHER PUBLICATIONS

Georgia Soil and Water Conservation Commission; "Curb Inlet Filter"; *Field Manual for Erosion and Sediment Control in Georgia;* Third Edition, pp. 86-87 (1997).

(Continued)

*Primary Examiner*—Christopher Upton
(74) *Attorney, Agent, or Firm*—Womble Carlyle Sandridge & Rice, PLLC

(57) ABSTRACT

A curb-and-grate inlet filter is provided for temporarily covering, during nearby construction activities, the curb-and-grate inlet of a storm drainage system so as to filter from storm water runoff silt and debris attendant such construction. The curb-and-grate inlet filter includes a body having a first and a second portion formed of interconnected coils. The filter also includes a filter medium that may enclose the body. The filter medium filters silt and debris from water passing through the filter and into the curb-and-grate inlet.

17 Claims, 4 Drawing Sheets

U.S. PATENT DOCUMENTS

| | | | | |
|---|---|---|---|---|
| 5,407,575 | A | 4/1995 | Vinsonhaler | 210/484 |
| 5,592,783 | A * | 1/1997 | Jones | 210/474 |
| 5,632,888 | A | 5/1997 | Chinn et al. | 210/163 |
| 5,725,782 | A | 3/1998 | Chinn et al. | 210/767 |
| 5,776,567 | A | 7/1998 | Schilling et al. | 428/34.5 |
| 5,843,306 | A | 12/1998 | Singleton | 210/163 |
| 5,948,250 | A | 9/1999 | Middleton | 210/232 |
| 5,954,952 | A | 9/1999 | Strawser, Sr. | 210/164 |
| 5,980,740 | A * | 11/1999 | Harms et al. | 210/163 |
| 6,004,457 | A | 12/1999 | Singleton | 210/163 |
| 6,015,489 | A | 1/2000 | Allen et al. | 210/131 |
| 6,017,166 | A | 1/2000 | Mossburg, Jr. | 404/5 |
| 6,041,944 | A * | 3/2000 | Meier | 210/497.1 |
| 6,261,445 | B1 | 7/2001 | Singleton | 210/163 |
| 6,464,428 | B1 * | 10/2002 | Mikell | 405/15 |
| 6,709,579 | B1 * | 3/2004 | Singleton et al. | 210/163 |
| 6,808,623 | B1 * | 10/2004 | Harris et al. | 210/164 |
| 2002/0130070 | A1 * | 9/2002 | Roesner | 210/163 |

OTHER PUBLICATIONS

Georgia Soil and Water Conservation Commission, "Curb Inlet Protection", *Manual for Erosion and Sediment Control in Georgia,* Fifth Ed., pp. 6-140; (2000).

Georgia Soil and Water Conservation Commission, "Curb Inlet Filter", *Manual for Erosion and Sediment Control in Georgia,* Fifth Ed., pp. 6-144; (2000).

* cited by examiner

CURB-AND-GRATE INLET FILTER

CROSS-REFERENCE TO RELATED APPLICATIONS

This application claims priority to U.S. Provisional Application Ser. No. 60/462,760, filed Apr. 14, 2003, which is incorporated by reference herein in its entirety.

TECHNICAL FIELD

The present invention generally relates to devices for filtration of water entering storm water drainage systems, and in particular to a barrier filter for a curb-and-grate inlet of a storm water drainage system to filter silt and debris from storm water passing into the storm water drainage system.

BACKGROUND

In the construction of streets, highways, residential housing developments, commercial developments, schools, airports and similar other types of construction projects, the road system generally is first marked out and the streets of the development are cleared and graded. Thereafter, the storm water drainage system for the development is constructed, which typically includes underground drainage pipes, collection basins, culverts, and drop inlets that form the connection between the storm water drainage system and a finished street side curb-and-grate inlet. As construction of the development continues, government regulations and building codes generally require that the storm water drainage system be kept substantially free of silt and sediment that might enter through the curb-and-grate inlet. Keeping silt and sediment out of the collection basins can, however, be difficult given additional grading and construction on site that can dislodge or disturb silt and sediment, which accordingly, will tend to migrate or be pushed towards the sides of the street by wind, water and construction activity and consequently is washed into the open curb-and-grate inlet. If silt and sediment are washed into or otherwise collect within the collection basins and/or other parts of the drainage system, the collection basins can become clogged. In that event, it becomes necessary to send workers down into the collection boxes to clean out the dirt and/or debris manually in order to comply with clean water regulations. Such cleaning operations are difficult as the pipes are somewhat cramped, making it difficult to maneuver. There is also the danger of cave-ins or collapses of silt, sediment, dirt, etc., that has built up around the sides of the collection basins, creating a significant risk of injury or even death to the workers below, as well as the negative environmental impact and clean water regulation violations from the migrating sediment.

Although the simplest solution to this problem would seem to be to seal the curb-and-grate inlet completely, this solution is not feasible because storm and run-off water must be permitted to drain through the drainage system to permit the ground to dry and to prevent storm water from eroding the work site and carrying soil and debris to adjacent lots, buildings or nearby lakes and streams. The streets and roadways also must be kept clear to prevent a potential traffic hazard from standing water.

In the past, various filter systems for protecting the curb-and-grate inlets of a storm water drainage system have been utilized. Unfortunately, most of these systems have suffered from various disadvantages, including, in some cases, a requirement that the inlet grate be removed from the drain inlet to install the filter system.

Accordingly, a need exists for a filter system for covering and protecting curb-and-grate inlets of a storm water collection basin of a drainage system to prevent silt and sediment from migrating into the inlet while allowing for the free and substantially complete drainage of storm water runoff into the curb-and-grate inlet.

SUMMARY

Briefly described, the present invention generally comprises a curb-and-grate inlet filter that forms a temporary barrier or filter for filtering runoff water entering a curb-and-grate inlet into a storm water drainage system. The curb-and-grate inlet filter enables water to pass therethrough and into the curb-and-grate inlet, while preventing a substantial portion of silt and debris flowing with the water from passing into the curb-and-grate inlet. The curb-and-grate inlet filter generally includes a body that supports a filter medium. The body is sized to fit over the grate and at least partially obstruct the inlet opening of the curb-and-grate inlet. The body typically includes one or more support members encapsulated within a cover or sleeve of filter material that assists in the filtering of water running to the curb-and-grate inlet by blocking silt and debris, while allowing water to pass therethrough.

The body generally includes a grid or support structure formed from one or more supports, such as polymeric coils, pipes, beams, or tubing. The grid provides support to the overall filter and is rigid enough to withstand the force of flowing storm water, while allowing storm water to flow therethrough. The filter medium generally can include geosynthetic materials, wire screens, mesh materials and various synthetics, nylons and/or natural woven or knitted fibers and combinations thereof, or other appropriate filtration material. The filter medium can be formed into a fitted cover that encapsulates the body, or a sheet or sleeve that partially encloses or is supported by the body.

In one example embodiment, the curb-and-grate inlet filter further comprises a body formed from a grid through which storm water can flow. The body includes a first section having a first elevation and a second section having a second elevation, with the second elevation generally being higher than the first elevation. The body is encapsulated in a cover of filter material that is substantially water permeable, while being substantially impermeable to silt and debris. The body can be formed of a plurality of coils that are interconnected. The coils can be formed of a polymeric material and fused together. The first of the body can serve as the portion of the filter that seats on and generally covers the grate of the curb-and-grate inlet, while the second section is aligned to cover at least a portion of the curb inlet.

Various aspects of the present invention will become apparent to those skilled in the art upon reading the following detailed description, when taken in conjunction with the accompanying drawings.

DETAILED DESCRIPTION

Figure 1:
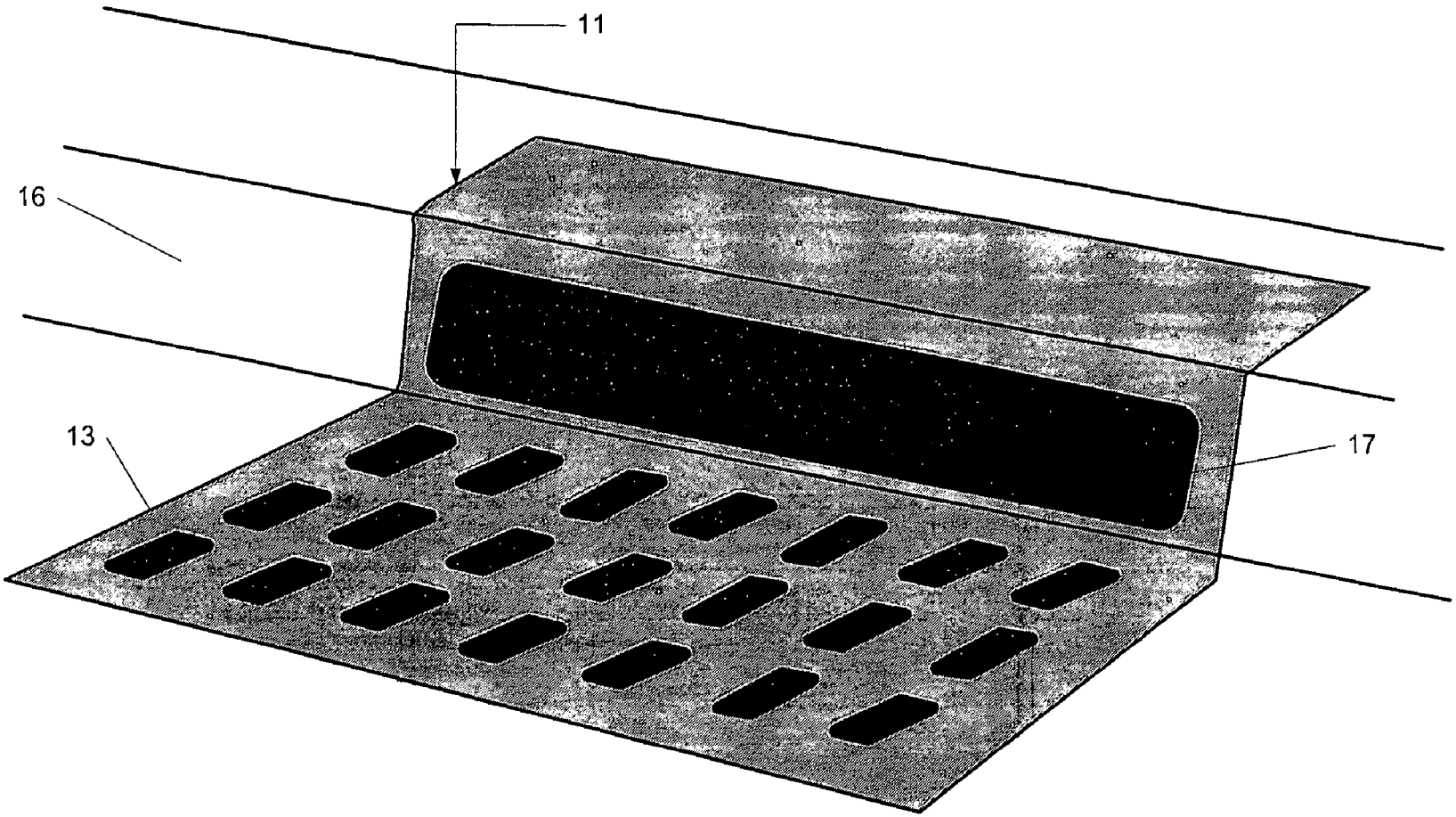
FIG. 1 is a perspective view of a typical curb-and-grate inlet.

Referring now to the drawings in which like reference numerals indicate like parts throughout the several views, FIGS. 1–4 illustrate a curb-and-grate inlet filter 10 (FIG. 3) that embodies principles of the present invention in a preferred form. The curb-and-grate inlet filter 10 generally is designed to temporarily cover a curb-and-grate inlet 11 (FIG. 1) of a storm water drainage system for filtering silt and debris from storm and/or run-off water. The filter 10 typically is used during construction in the vicinity to filter storm water runoff passing through the curb-and-grate inlet and into the storm water drainage system to prevent silt and debris from collecting within the underground pipes and collection boxes of the drainage system.

Storm water drainage systems typically will include underground concrete or metal drainage pipes and/or collection basins, with curb-and-grate inlets 11 embedded within street curbs 16 and communicating with the underground plumbing. The curb-and-grate inlet 11 of a storm water drainage system typically includes a grate portion 13 covering a drain, and a sloped mouth 17 overlapping the curb 16 as shown in FIG. 1, defining flow opening emptying into a catch basin, as shown in FIG. 1. The curb-and-grate inlet 11 receives storm water and other excess runoff water from the adjacent roadway to aid in storm water runoff drainage and to reduce the likelihood of flooding at the site. During construction, the presence of loosened and exposed soil and construction-related silt and debris increases the possibility that storm water runoff will carry such material into the storm water drainage system through the curb-and-grate inlets 11.

Figure 2:
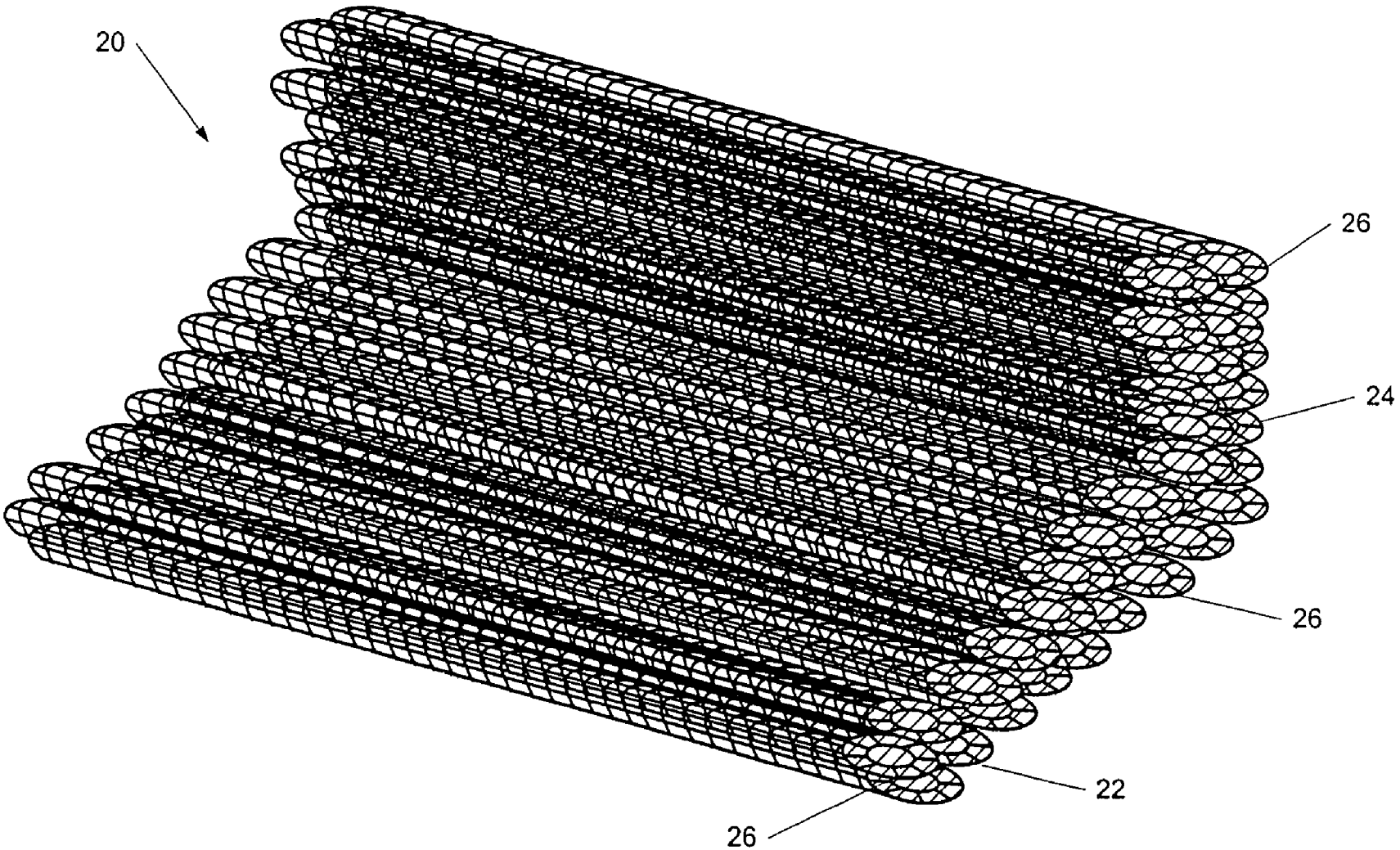
FIG. 2 is a perspective view illustrating the structure body of a curb-and-grate inlet filter embodying principles of the present invention.
Figure 3:
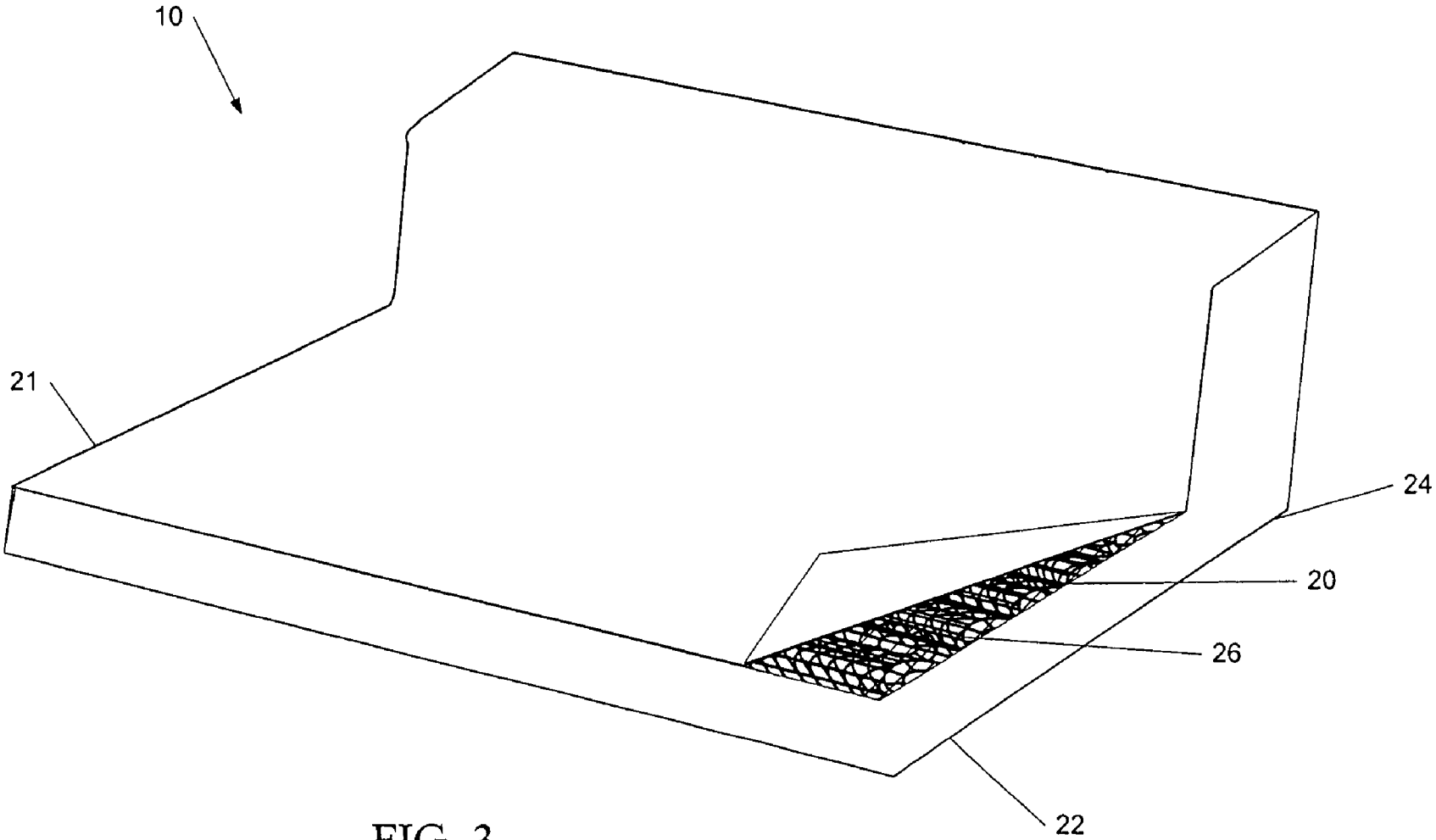
FIG. 3 is a perspective view of a curb-and-grate inlet filter embodying principles of the present invention.
Figure 4:
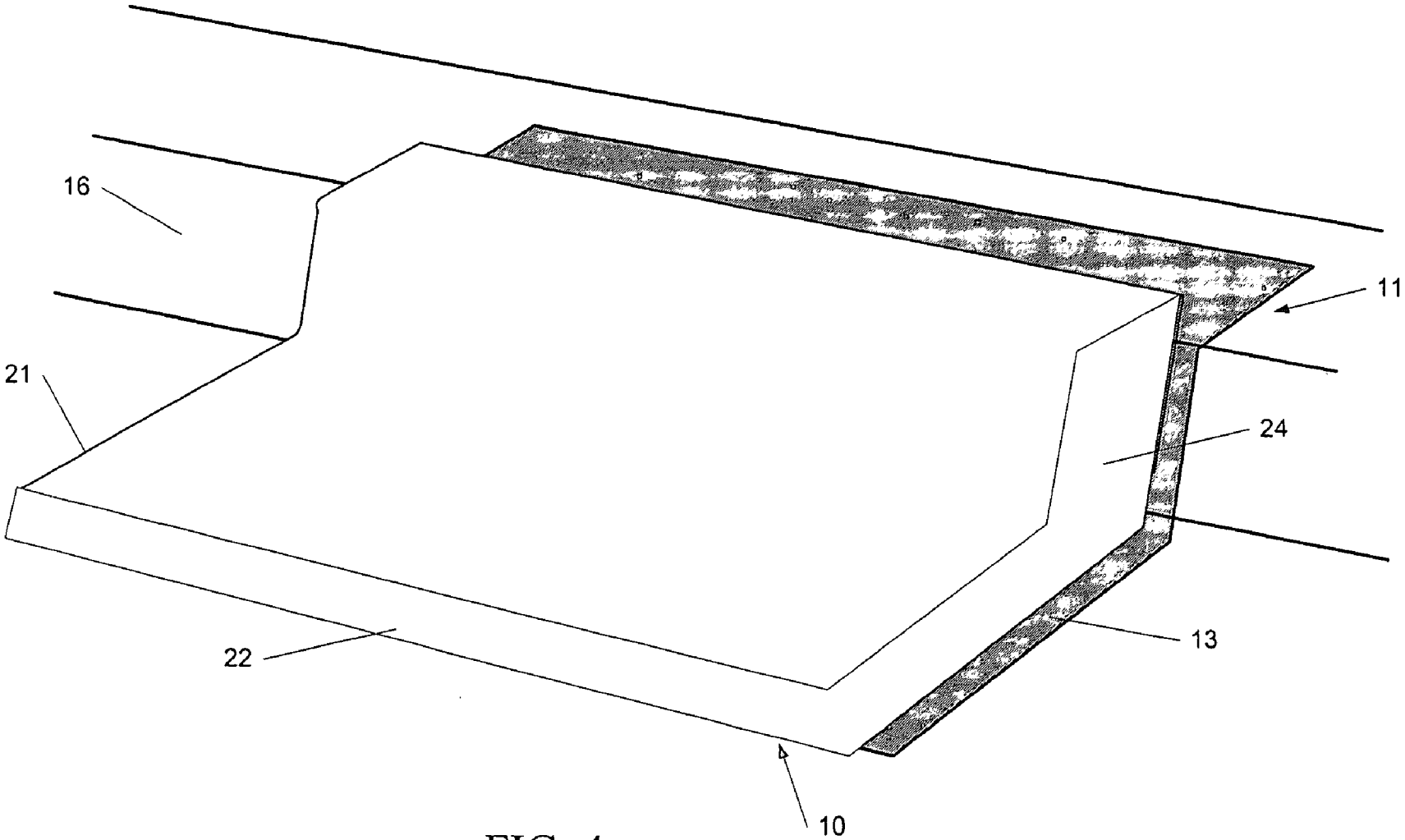
FIG. 4 is an exploded perspective view showing the curb-and-grate inlet filter of FIG. 3 positioned adjacent and covering a curb-and-grate inlet.

As shown in to FIGS. 2–4, the curb-and-grate inlet filter 10 generally includes at least a semi-permeable body 20 that generally is substantially rectangular or box-like, although it can be formed in any other convenient shape as desired or necessary for substantially covering the curb-and-grate inlet. The body 20 generally includes a first section 22 and a second section 24. The first section 22 has a first elevation and is generally of a size and shape adapted to substantially completely cover the grate of a curb-and-grate inlet. Thus, as shown in FIG. 4, the first section 22 of the body 20 is generally rectangular and can thereby cover substantially all of a generally rectangular grate 13, although it can also be formed in other, varying shapes or configurations as needed to fit over and cover the grate 13. The second section 24 of the body 20 generally projects at an angle away from the first section 22 and has a second elevation that is not equal to the first elevation. The second elevation typically is higher than the first elevation so that the body will substantially match the contour of the curb-and-grate inlet, with the second section 24 of the body 20 substantially covering or enclosing the curb inlet 17 of the curb-and-grate inlet 11.

As shown in FIG. 2, the body 20 is formed of a durable substantially rigid material generally formed as a semi-permeable grid or similar open structure having a plurality of flow openings through which storm water can flow. The body includes a plurality of coils 26 that are attached to each other. In the embodiment shown in FIG. 2, the coils 26 are end-fused together to form an integral body 20. Other forms of attachment of the coils are contemplated, including adhesives, straps, ties, staples, rings and other fasteners. Alternatively, the coils 26 or other supports provided to form the body of the filter can be provided in a stacked, unattached configuration and loosely filling the cover 21. Each coil generally is cylindrical and open at either end. Each coil is formed of a mesh, grate or latticework of material so as to provide shape and rigidity to the body, while also allowing for the flow of water through the body 20. Each coil 26, shown in FIGS. 2 and 3, is formed of an open mesh, grid work, latticework or grating of water resistant material that can support the filter medium and maintain its shape when subjected to outside forces, such as running storm water. Polymeric or synthetic materials may be used to form the mesh of the coils, although other materials such as aluminum, other metals and other, similar light-weight, durable, corrosion resistant materials. In one embodiment, the coils 26 are about 1.5 inches (3.8 cm) in diameter and formed of a resilient, water corrosion resistant material, such as high density polyethylene (HDPE). Each coil 26 is sufficiently rigid and has sufficient weight and/or bulk to maintain the position and shape of the body 20 when subjected to a flow of storm water, but is resilient enough to yield to the force of an automobile tire rolling over it, so as to not create a driving hazard on a roadway.

In one example, the body 20 of the curb-and-grate inlet filter 10 is about 25–30 inches (76.2 cm) wide, about 18–20 inches (45.7 cm) deep, about 2–4 inches (7.6 cm) high at the first elevation at the first section 22 and about 6–10 inches (20.3) high at the second elevation at the second section 24. However, filters with alternative dimensions appropriate for use with curb-and-grate inlets are contemplated. Approximately two or more layers of coils typically are fused or otherwise attached together to form the first section 22 of the body 20 of the curb-and-grate inlet filter 10. Approximately three or more layers of coils further generally are fused on top of the two initial or base layers to form the elevated second section 24 of the body 20.

As shown in FIG. 3, the body 20 is substantially covered or encapsulated within a cover 21, which allows water to pass therethrough but tends to block silt and other debris from passing. The cover 21 is formed of a filter material or medium that can include a geotextile material or similar mesh or fabric filtering material. As used herein, the term "geotextile" refers to any woven or non-woven filter material that can act to separate, reinforce, filter, drain, or serve as a moisture barrier. Examples of the materials that can be used as the filter medium include silt screen materials, mesh materials, wire screens, polyesters, nylons, polyvinyl chlorides or woven fiber blankets, such as formed from cotton or coconut fibers, or other synthetic or natural screening materials, or any other suitable material that can effectively filter silt and debris from water. The cover 21 generally is provided as a fitted cover or sheet that is applied about and encloses the body 20.

In use, as illustrated in FIG. 4, the curb-and-grate inlet filter 10 of the present invention is placed on the grate 13 and adjacent the mouth 17 of the curb-and-grate inlet 11 so that water running along the curb 16 towards the curb-and-grate inlet 11 encounters the curb-and-grate inlet filter 10. The curb-and-grate inlet filter generally will have sufficient weight and/or bulk to secure it in its filtering position, although straps, ballasts or other securing means also can be used as desired or needed. When the water flow encounters the curb-and-grate inlet filter 10, the water passes through the cover 21 and flows through the coils 26 of the body 20, then out of the filter 10 and into the curb-and-grate inlet 11. A substantial portion of the silt and debris carried by the water is stopped by the curb-and-grate inlet filter 10 before it enters the curb-and-grate inlet 11. This substantial portion of the silt and debris can thus accumulate in and around the curb-and-grate inlet filter 10, but will be prevented from passing into the curb-and-grate inlet 11. After use, the silt and debris that has collected in and around the curb-and-grate inlet filter 10 is removed for disposal, and the curb-and-grate inlet filter 10 generally will then be cleaned of any silt and debris collected therein such as by removing the cover and washing, shaking, blowing or otherwise evacuating the silt and debris from the cover and coils of the filter body. Thereafter, the curb-and-grate inlet filter 10 can be easily transported and reused at another site.

Accordingly, it can be seen that a unique, temporary filter system for a storm drain is provided. The filter can withstand the accompanying force of water passing therethrough and silt and sediment urged or collected thereagainst to prevent this silt and sediment from passing into the curb-and-grate inlet, while still enabling storm water runoff to be drained from the site without the drainage system or adjacent streams or lots becoming clogged with eroded soil and construction debris.

It will be understood by those skilled in the art that while the present invention has been described in terms of certain embodiments and methodologies, numerous modifications, additions and deletions can be made without departing from the spirit and scope of the invention.

What is claimed is:

1. A filter for a curb-and-grate inlet comprising:

a semi-permeable body comprising a plurality of interconnected coils through which storm water can flow, said body comprising:

a first section having a first elevation; and a second section having a second elevation, wherein said second elevation is higher than said first elevation; and a cover encapsulating said body, wherein said cover comprises a filter material that is substantially water permeable and substantially impermeable to silt and debris.

2. The filter of claim 1, wherein said plurality of coils is formed from a polymeric material.

3. A filter for a curb-and-grate inlet comprising:

a body formed of a plurality of coils through which storm water can flow, each coil having a pair of ends and a length, the plurality of coils arranged in a side by side configuration so that the ends thereof are substantially aligned; and a cover encapsulating said body, wherein said cover comprises a filter material that is substantially water permeable and substantially impermeable to silt and debris.

4. The filter of claim 3, wherein said coils of said plurality of coils are fused together.

5. The filter of claim 3, wherein filter material comprises a geotextile material.

6. The filter of claim 3, wherein said plurality of coils is formed of a polymeric material.

7. The filter of claim 3, wherein said plurality of coils is formed of a metal material.

8. The filter of claim 3, wherein body includes a first section having a first elevation and a second section having a second elevation, and wherein said first and said second elevations are not equal.

9. A filter for a curb-and-grate inlet comprising:

a body comprising a plurality of coils through which storm water can flow; and a cover encapsulating said body, wherein said cover comprises a filter material that is substantially permeable to water and substantially impermeable to silt and debris, wherein said body includes a first section baying a first elevation and a second section having a second elevation, and wherein said first and second elevations are not equal.

10. The filter of claim 9, wherein the coils are fused together along at least a first end of each coil.

11. A filter for a curb-and-grate inlet comprising:

a body comprising a plurality of interconnected coils formed from a rigid, durable, light-weight polymeric material and having a series of flow openings through which storm water can flow, wherein said body includes a first section having a first elevation and a second section having a second elevation, wherein said elevation is not equal to said second elevation; and a cover encapsulating said body, wherein said cover comprisies a filter material being water permeable and substantially impermeable to silt and debris.

12. The filter of claim 11, wherein said filter material includes geotextile material.

13. The filter of claim 11, wherein said body is fanned of a polymeric material.

14. The filter of claim 11, wherein said body is formed of a metal material.

15. A filter for a curb-and-grate inlet comprising:

a substantially rigid, semi-permeable body through which storm water can flow, said body comprising a plurality of interconnected coils including:

a first section having a first elevation; and a second section having a second elevation, wherein said second elevation is higher than said first elevation; and a cover encapsulating said body, wherein said cover comprises a flexible filter material that is substantially water permeable and substantially impermeable to silt and debris.

16. The filter of claim 15, wherein said plurality of coils is formed from a polymeric material or a metal.

17. A filter for a curb-and-grate inlet comprising:

a plurality of coils, each having a first end, a second end, and a length, the plurality of coils arranged in a side by side configuration so the ends thereof are substantially aligned, at least the first end of the coil being fused together and the second end of the coils being fused together to form a substantially unitary body; and a cover supported on the body, wherein the cover comprises a filter material being permeable to water and substantially impermeable to silt and debris, wherein the body includes a first section having a first elevation and a second section having a second elevation, wherein the first elevation is not equal to the second elevation.

* * * * *